United States Patent [19]

Dontscheff

[11] Patent Number: 4,517,872

[45] Date of Patent: May 21, 1985

[54] CONTROLLED DEPTH CUTTING METHOD AND APPARATUS

[75] Inventor: Helmut Dontscheff, Tacoma, Wash.

[73] Assignee: The Boeing Company, Seattle, Wash.

[21] Appl. No.: 509,662

[22] Filed: Jun. 30, 1983

[51] Int. Cl.[3] ..... B65D 3/08

[52] U.S. Cl. ..... 85/880; 83/887; 83/471.2; 83/489; 83/508; 83/614

[58] Field of Search ..... 83/879, 880, 881, 887, 83/56, 433, 471.2, 471.3, 477.1, 483, 485, 488, 487, 489, 508, 508.2, 482, 449, 614, 17, 176; 156/523, 584

[56] References Cited

U.S. PATENT DOCUMENTS

| | | | |
|---|---|---|---|
| 1,059,200 | 4/1913 | Parkinson et al. | 83/886 |
| 1,341,262 | 5/1920 | Colburn | 225/96.5 X |
| 2,066,752 | 1/1937 | Ward | 92/53 |
| 2,217,923 | 10/1940 | Silverman | 30/167 |
| 2,291,809 | 8/1942 | Jackson | 146/98 |
| 2,367,432 | 1/1945 | Reprogle | 30/167 |
| 2,571,527 | 10/1951 | Boyer | 30/167 |
| 2,617,186 | 11/1952 | Pickles | 30/144 |
| 2,706,002 | 4/1955 | Whittamore | 83/885 |
| 3,143,023 | 8/1964 | Addin | 83/472 |
| 3,165,951 | 1/1965 | Lindquist | 83/507 X |
| 3,224,092 | 12/1965 | Nagel | 30/273 |
| 3,807,261 | 4/1974 | Couvreur | 83/6 |
| 3,977,055 | 8/1976 | Gilpatrick | 26/9 |
| 4,118,268 | 10/1978 | Price | 156/510 |
| 4,130,042 | 12/1978 | Reed | 83/887 |
| 4,210,052 | 7/1980 | Fisher | 83/881 |
| 4,217,693 | 8/1980 | Roder | 30/292 |
| 4,263,827 | 4/1981 | Pontarollo | 83/507 X |

OTHER PUBLICATIONS

Article from Design News, pp. 136–137 of the 1/24/83 issue, entitled "CNC Machine Slashes Laminated Composites Cost", by E. J. Stefanides.

*Primary Examiner*—James M. Meister

*Attorney, Agent, or Firm*—Delbert J. Barnard; Joan H. Pauly

[57] ABSTRACT

Tape (100) being laid by a tape laying machine (2) is transported by a continuous strip of backing paper (102). A rotary cutter (12) is mounted on one arm (36) of a C-shaped frame (34). An anvil (20) is mounted on the other arm (38). Frame (34) moves laterally to move cutter (12) and anvil (20) laterally across tape (100) with tape (100) and paper (102) therebetween. A single point on anvil (20) supports the portion of tape (100) being cut throughout the length of the cut. Therefore, an essentially constant distance between cutter (12) and anvil (20) is maintained to completely sever tape (100) without severing paper (102).

16 Claims, 6 Drawing Figures

Fig. 4
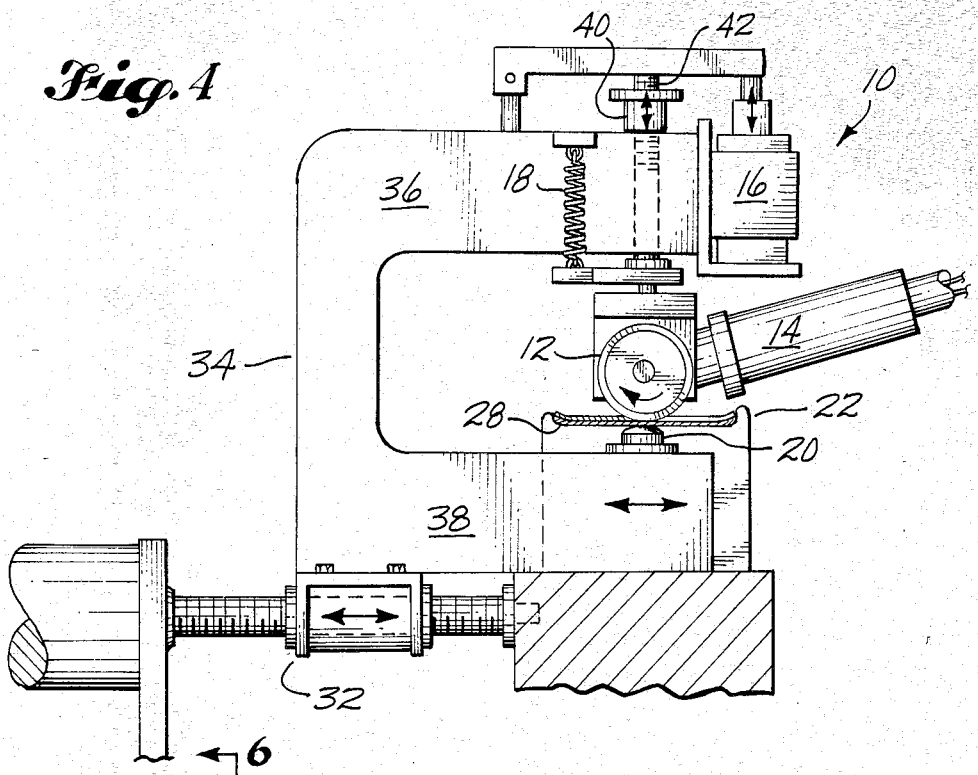
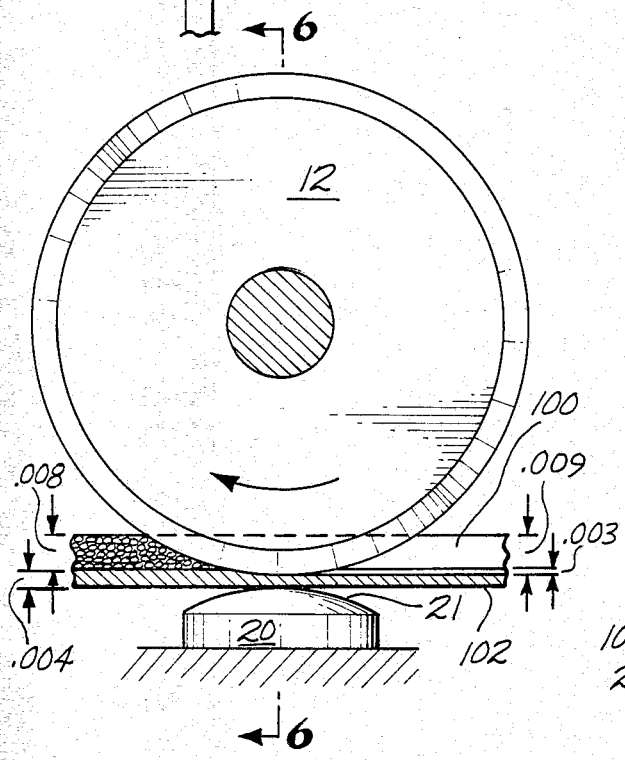
Fig. 5
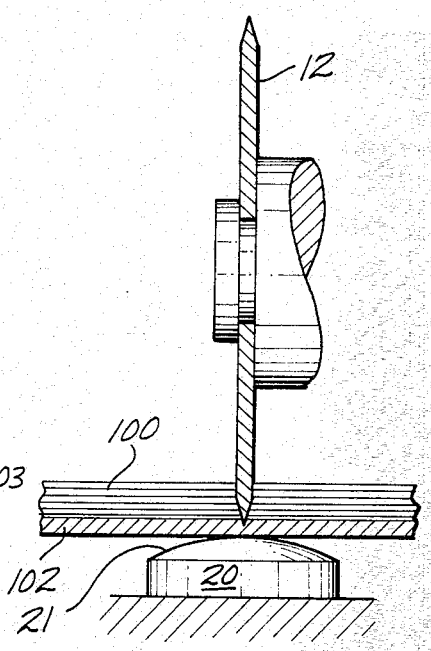
Fig. 6

CONTROLLED DEPTH CUTTING METHOD AND APPARATUS

DESCRIPTION

1. Technical Field

This invention relates to methods and apparatus for cutting strip or sheet material and, more particularly, to such a method and apparatus in which a laterally moving cutter cuts only the top layer of a double layer and in which the lower layer is protected from being cut by accurately controlling the depth of the cut.

2. Background Art

This invention is directed primarily toward providing an improved cutting system for use in tape laying machines. Such tape laying machines are known in the art and are used for manufacturing aircraft structures from composite tape materials. An example of a type of tape laying machine into which the method and apparatus of the present invention could advantageously be incorporated is the machine developed by the Vought Corporation and described in the Jan. 24, 1983 issue of Design News, in the article on pages 136 and 137 entitled "CNC Machine Slashes Laminated Composite Cost".

The composite tape materials used in conjunction with automatic tape laying machines for manufacturing aircraft structures are normally provided in double layer form. The top layer is the composite material itself, and the bottom layer is backing paper. The purposes of the backing paper include preventing the sticking together of layers of the composite material in rolls of the tape, preventing resin build-up on machine parts, and providing a continuous strip for transporting the tape from the supply reel. Because of the last named purpose, it is of course necessary to avoid cutting through the paper when the top layer of composite tape material is cut.

A problem that is encountered with known methods for cutting the top layer is that, because the backing paper is only a few thousandths of an inch thick, it is extremely difficult to cut the top layer of composite tape material to the last fiber and leave the backing paper sufficiently intact to provide uninterrupted transport of the tape material. In known tape laying machines with cutting means that moves laterally across the tape, a stationary anvil is provided to support the tape material and backing paper across the width of the tape while a lateral cut is being made. In order to maintain an essentially constant depth of the cut, it is necessary to have an essentially constant distance between the cutting blade and the anvil. Therefore, it is necessary for the lateral movement of the cutter to be essentially parallel to the surface of the anvil facing the cutter. This near perfect parallel relationship is extremely difficult if not impossible to attain and maintain. Any imperfections on the anvil surface due to imperfect manufacture or uneven wear and any play in the movement of the cutter will affect the depth of the cut being made. The resulting imperfections in the depth control of the cut can lead to tape fibers escaping being cut or cutting of the backing paper of a sufficient magnitude to impair its ability to transport the tape.

The undesirability of such missed fibers should be obvious. If they are not detected in time, they will be pulled along with the backing paper as the tape laying head moves into position to lay the next course. This ruins the course of composite material that has just been laid. The machine has to be stopped and the damaged composite material must be removed before the tape laying process can be resumed. This results in considerable additional expense due to increased personnel costs, wasteful downtime of an expensive tape laying machine, and waste of the damaged composite material which must be discarded. Even if the missed fibers are detected in time, the cost of the operation is still significantly increased. The machine must be stopped to allow the missed fibers to be cut by hand. Again valuable machine time is lost and personnel costs are increased. The machine operator has idle time and at least one extra worker is required just to watch for missed fibers, shut down the machine as necessary, and hand cut missed fibers. In addition to the increased cost, the hand cutting process has the added disadvantage of being relatively imprecise, resulting in a lessening of the quality of the finished composite structure.

The undesirability of cutting the paper should also be obvious. If the cuts in the paper are extensive enough to impair the transport of the tape by the backing paper, the machine has to be stopped to repair the damaged portion of the backing paper. This again results in considerable additional expense due to increased personnel costs, wasteful downtime of an expensive tape laying machine and waste of composite tape material that cannot be laid by the machine because it must be advanced beyond the tape laying head to insure that the take up reel securely engages the backing paper.

The depth of the lateral cut in the tape needs to be controlled within very narrow tolerances. Areas of the cuts that are either too shallow or too deep lead to the severe disadvantages described above. Therefore, the primary object of the present invention is to provide a method and apparatus for accurately controlling the depth of such cuts to thereby decrease the cost of the tape laying operation and improve the quality of the finished product.

The following United States patents each disclose a rotary cutter for cutting a layer of material:

U.S. Pat. No. 2,217,923, granted Oct. 15, 1940, to A. I. Silverman;

U.S. Pat. No. 2,367,432, granted Jan. 16, 1945, to F. Reprogle;

U.S. Pat. No. 2,571,527, granted Oct. 16, 1951, to M. Boyer;

U.S. Pat. No. 2,617,186, granted Nov. 11, 1952, to J. A. Pickles; and

U.S. Pat. No. 3,224,092, granted Dec. 21, 1965, to D. W. Nagel.

Each of these patents, except Nagel, discloses a cutter for cutting plaster casts to remove them from a patient. Nagel discloses a cutter for cutting excess material off of carpet during the installation process. Each of the devices described in these five patents includes a guard or spacer member that moves with the rotary cutter under the layer of material to be cut so that such layer is between the rotary cutter and the guard or spacer member. The layer of material between the cutter and the guard or spacer member is cut all the way through.

The following United States patents each disclose apparatus in which a rotary cutter or marking tool is employed to process a single layer of material that is positioned between the cutter or tool and a support member, and in which the cutter or tool and/or the support member is stationary:

U.S. Pat. No. 1,059,200, granted Apr. 15, 1913, to G. W. Parkinson et al;

U.S. Pat. No. 2,291,809, granted Aug. 4, 1942, to A. L. Jackson;

U.S. Pat. No. 3,143,023, granted Aug. 4, 1964, to K. G. S. Addin; and

U.S. Pat. No. 4,210,052, granted July 1, 1980, to A. R. Fisher.

U.S. Pat. No. 2,066,752, granted Jan. 5, 1937, to S. B. Ward discloses a C-shaped gauge that is used to find radial holes in a metal cylinder that has a rubber jacket. U.S. Pat. No. 3,807,261, granted Apr. 30, 1974, to J. M. Couvreur discloses apparatus for scoring or cutting sheet material such as glass. The scoring or cutting tool moves laterally across the glass which is supported on a bed that is either stationary or moves longitudinally to advance the glass in a direction generally perpendicular to the direction of movement of the scoring or cutting tool. U.S. Pat. No. 4,118,268, granted Oct. 3, 1978, to E. Price discloses apparatus in which a rotary cutter is used to cut a layer of surfacing material that is held in position to be cut by a support fence that is urged against a surface perpendicular to the layer of surfacing material. Both the cutter and the supporting fence appear to be stationary, and the layer of surfacing material being cut is moved past the cutter.

U.S. Pat. No. 3,977,055, granted Aug. 31, 1976, to M. W. Gilpatrick; U.S. Pat. No. 4,130,042, granted Dec. 19, 1978, to C. F. Reed; and U.S. Pat. No. 4,217,693, granted Aug. 19, 1980, to H. H. Roder et al each disclose apparatus for controlling the depth of a cut or score in a layer of material. Gilpatrick discloses a cutter for cutting loops in fabric. The cutter includes a circular rotating member with a number of circumferentially spaced blades projecting from its outer circumference. The backing of the fabric is protected from being cut by a number of guards extending radially outwardly from the circumference of the circular member parallel to the blades. Reed discloses a die cutter assembly for cutting label material without cutting the backing strip. The assembly inclues a precisely machined die cutting roll and an anvil roll both of which rotate and the spacing between which is controlled by a pair of bearings. Roder et al disclose a controlled depth scoring tool for scoring composite labels of the type commonly used on cylindrical packages of ready-to-cook biscuits. The width of the blade portion that is allowed to penetrate the label is controlled by a collar that is concentric with and adjacent to the rotary cutter.

The above patents and the prior art that is discussed and/or cited therein should be studied for the purpose of putting the present invention into proper perspective relative to the prior art.

DISCLOSURE OF THE INVENTION

A subject of the invention is apparatus for making a cut in sheet material along a cutting path while maintaining along said path an uncut layer of said material of essentially constant thickness. According to an aspect of the invention, the apparatus comprises frame means having opposed first and second portions positioned to move along said path. Cutting means is mounted on the first portion to move with said first portion along said path. An anvil is mounted on said second portion facing the cutting means to move simultaneously with said first and second portions and the cutting means along said path and to support the sheet material when said material is being cut. When a cut is being made, said first and second portions move along said path with said material therebetween. The simultaneous movement of the cutting means and the anvil maintains a single point on the anvil supporting the portion of the sheet material being cut throughout the length of the cut. This maintains an essentially constant distance beween the cutting means and the anvil to thereby maintain along the cutting path an uncut layer of said material of essentially constant thickness.

According to another aspect of the invention, the frame means comprises a rigid generally C-shaped frame having a center portion and two opposed spaced-apart arms projecting generally perpendicularly outwardly from said center portion. These arms include said first and second portions of the frame means. Preferably, the apparatus further includes drive means for moving said frame to move said first and second portions along said path.

The apparatus may also include certain preferred features. One such preferred feature is cutting means that comprises a rotary cutting blade. Another such preferred feature is an anvil that includes a rounded support surface facing the cutting means, said surface having an apex forming a support point for the portion of the sheet material being cut by the cutting means.

Another subject of the invention is an improved cutting apparatus for making lateral cuts through tape in a tape laying machine of the type in which a tape to be laid is transported by a continuous strip of backing material. According to an aspect of the invention, the apparatus comprises frame means having opposed first and second portions positioned to move laterally across the tape. Cutting means is mounted on said first portion to move with said first portion laterally across the tape. An anvil is mounted on said second portion facing the cutting means to move simultaneously with said first and second portions and the cutting means laterally across the tape and to support the tape and backing material when the tape is being cut. When a lateral cut through the tape is being made, said first and second portions move laterally across the tape with the tape and the backing material therebetween. The simultaneous movement of the cutting means and the anvil maintains a single point on the anvil supporting the portion of the tape being cut throughout the length of the cut. This maintains an essentially constant distance between the cutting means and the anvil to thereby maintain an essentially constant depth of the cut and completely sever the tape without severing the backing material.

According to a preferred aspect of the invention, the frame means comprises a rigid generally C-shaped frame having a center portion and two opposed spaced-apart arms projecting generally perpendicularly outwardly from said center portion. These arms include said first and second portions of the frame means. Preferably, the apparatus further comprises drive means for moving said frame to move said first and second portions laterally across the tape, said drive means comprising ball screw drive means.

According to another preferred aspect of the invention, the cutting means comprises a rotary cutting blade. Preferably, the apparatus further comprises cutter drive means for rotating said cutting blade at a sufficiently high rate to ensure that a maximum radius portion of the blade comes into cutting contact with each portion of the tape being cut. Rapid rotation of the cutting blade makes it possible to make the cut relatively quickly without sacrificing the completeness of the cut.

According to another aspect of the invention, the apparatus further comprises a guide surface along which the tape and backing material move into position for the tape to be cut by the cutting means. This guide surface includes two longitudinally spaced longitudinal sections defining a gap therebetween in which the anvil moves. The anvil is positioned to extend slightly out of the gap toward the cutting means.

According to another preferred aspect of the invention, the anvil includes a rounded support surface facing the cutting means. This surface has an apex forming a support point for the portion of the tape being cut by the cutting means.

Still another subject of the invention is a method of controlling the depth of lateral cuts through tape to completely sever the tape without impairing the transport of the tape in a system in which tape in a tape laying machine is transported by a continuous strip of backing material and in which said machine has cutting means for making lateral cuts through the tape and support means for the tape and backing material. According to an aspect of the invention, the method comprises moving the tape and the backing material between the cutting means and the support means into position for the tape to be cut by the cutting means. The tape is cut by the cutting means, and the portion of the tape being cut and the backing material are supported by the support means. While cutting the tape and supporting said portion of the tape and the backing material, the cutting means and the support means are moved simultaneously laterally across the tape and the backing material to maintain an essentially constant distance between the cutting means and the support means. This maintains an essentially constant depth of the cut and completely severs the tape without severing the backing material.

Tape laying machines constructed according to the present invention solve the problem described above of maintaining depth control that is sufficiently accurate to cut the top layer of composite tape material to the last fiber and leave the backing paper sufficiently intact to provide uninterrupted transport of the tape material. By providing a solution to this problem, the present invention avoids all of the disadvantages discussed above relating to tape fibers escaping being cut or cutting of the backing paper of a sufficient magnitude to impair its ability to transport the tape. A course of tape just laid by the tape laying machine is completely severed so that it will not be disturbed by movement of the tape laying head into position to lay the next course. Therefore, there is no need to have an extra worker present to watch for fibers missed by the cutting means and no need to shut down the machine to cut missed fibers or remove damaged tape. Moreover, the backing paper is left sufficiently intact to continue to perform its function of transporting the tape and, therefore, there is no need to shut down the machine to repair damaged portions of the backing paper. The machine operator has no unnecessary idle time, and the machine can be used to maximum efficiency to accomplish a maximum amount of tape laying without unnecessary interruptions. The overall cost of the operation is decreased because of lower personnel costs, more efficient use of the expensive machinery, and minimal wastage of the composite tape. The cost of the machine itself is also decreased since apparatus constructed according to the invention does not require a large machined anvil surface or a nearly perfect parallel cutter guide, which are extremely costly to produce. In addition, the quality of the finished composite structure is maximized and is not impaired by relatively imprecise hand cutting.

These and other advantages and features will become apparent from the detailed description of the best mode for carrying out the invention that follows.

BRIEF DESCRIPTION OF THE DRAWINGS

In the drawings, like element designations refer to like parts throughout and;

FIG. 4 is an elevational view of the cutting apparatus shown in FIG. 3, with parts shown in section.

FIG. 5 is an enlarged fragmentary elevational view showing the cutting blade and anvil shown in FIG. 4.

FIG. 6 is a sectional view taken along the line 6—6 in FIG. 5.

BEST MODE FOR CARRYING OUT THE INVENTION

Figure 1:
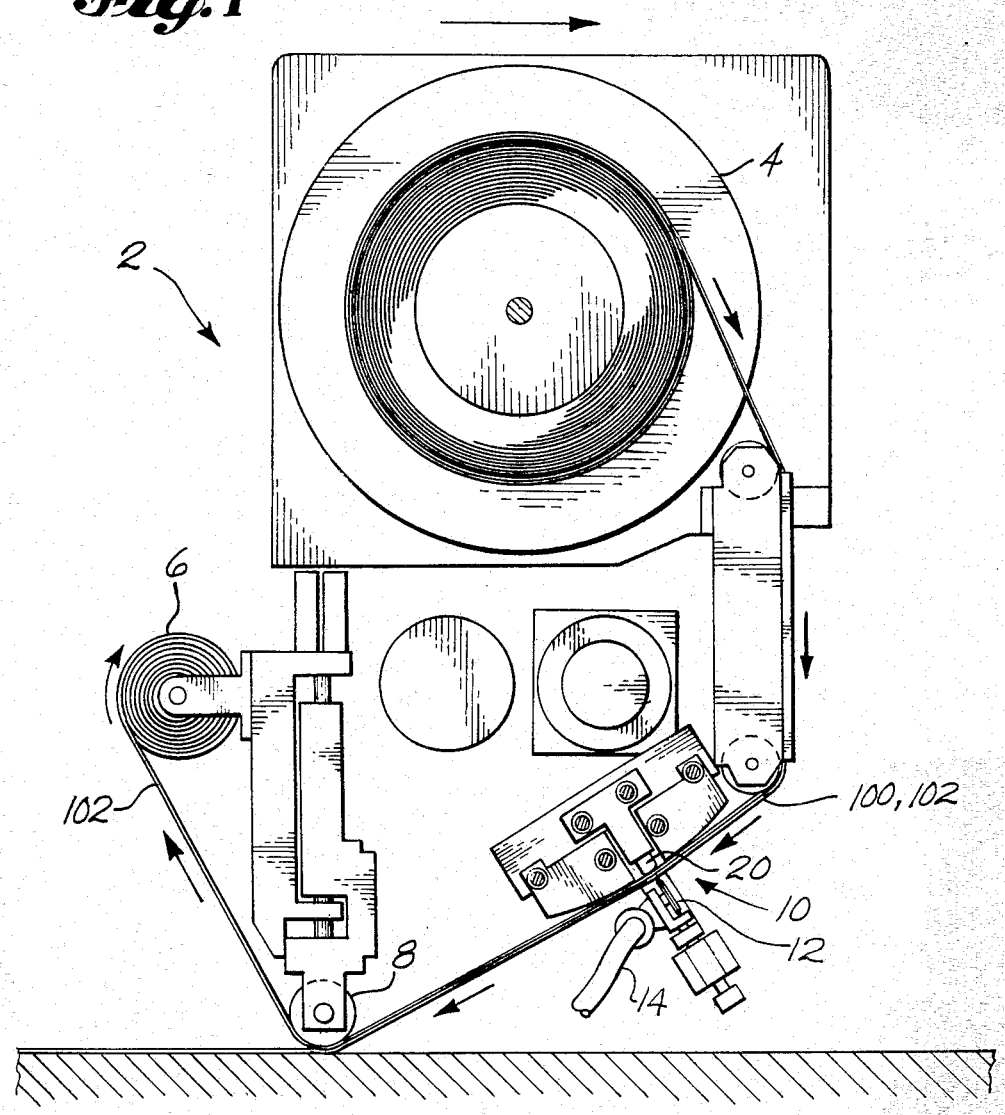
FIG. 1 is a side elevational view of a tape laying machine into which the preferred embodiment of the present invention has been incorporated.

The drawings show a tape laying machine 2 in which the cutting apparatus 10 is constructed according to the invention and also constitutes the best mode of the invention currently known to the applicant. The illustrated machine 1 is of the type designed to lay tape on flat surfaces, as shown in FIG. 1. When a machine of this type is used in the manufacture of contoured aircraft structures, a flat surface is first produced by the tape laying operation and then is heat treated to cure it into the desired shape. The machine 1 is only one example of a type of machine into which the present invention may be incorporated to advantage. Another example is the type of tape laying machine that lays tape directly onto a contoured surface.

FIG. 1 is a simplified side elevational view of the machine 2 showing a number of conventional features. These conventional features include the supply reel 4, the take up reel 6, and the tape laying head 8. As in conventional tape laying machines, the tape 100 and backing paper 102 move from supply reel 4 down through the cutting apparatus 10 to the tape laying head 8. In general, the action of the tape laying head against the tape and paper 100, 102 is sufficient to pull the tape and paper 100, 102 from the supply reel 4. The axial shaft of the take up reel 6 is driven to rotate the reel 6 to insure that the paper 102 remains taut and moves smoothly from the downstream side of the head 8 to the reel 6. These features are conventional and are described herein to illustrate an environment in which the method and apparatus of the present invention may be used to advantage. It is of course to be understood that such conventional features may take various forms and may be changed, omitted, or added to without affecting the spirit and scope of the present invention.

Figure 2:
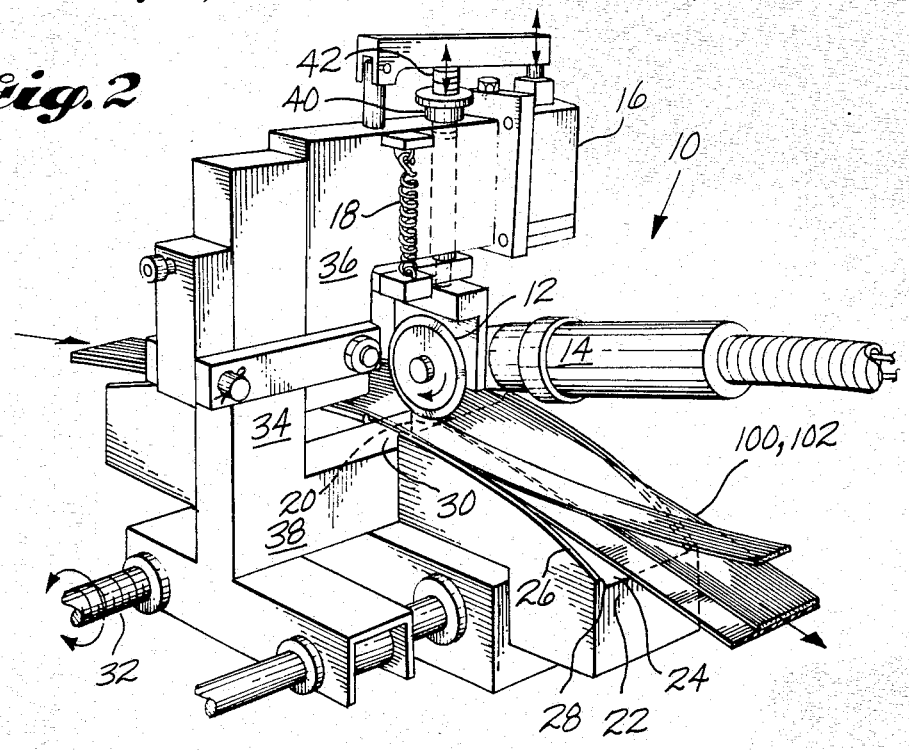
FIG. 2 is a pictorial view of the cutting and tape guide portions of the machine shown in FIG. 1, showing a lateral cut of a very small angle being made.
Figure 3:
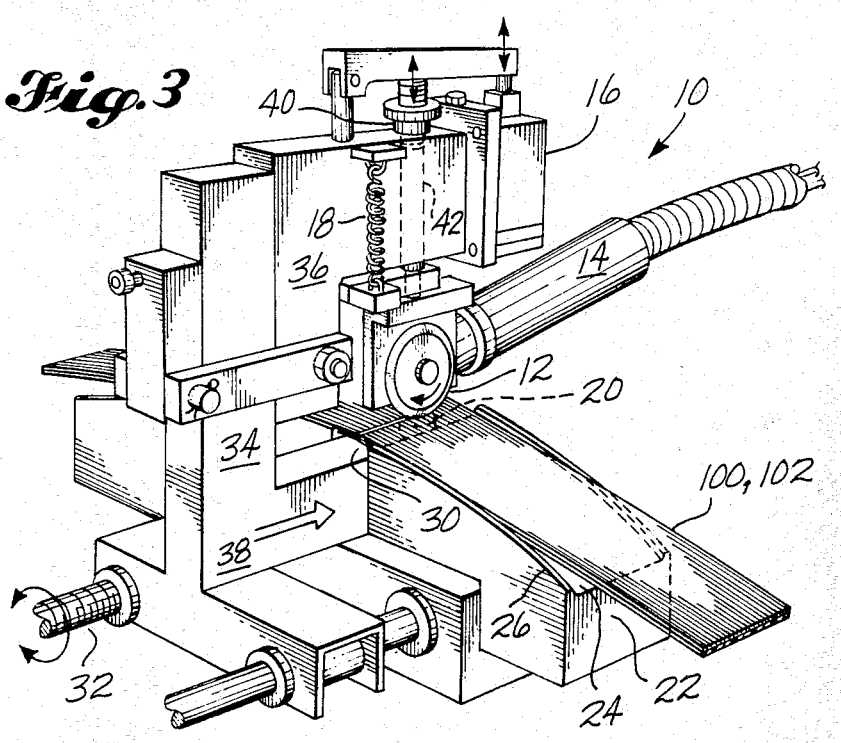
FIG. 3 is like FIG. 2 except that the cutter is shown making a lateral cut of about 90 degrees.

FIGS. 2 and 3 show the preferred embodiment of the cutting apparatus 10 of the invention. FIG. 2 shows a lateral cut of a very small angle, in the order of about 4 degrees, being made. FIG. 3 shows a lateral cut of approximately 90 degrees being made. Lateral cuts of both of the illustrated orders of magnitude, as well as lateral cuts intermediate between the illustrated cuts, can be made completely, efficiently, and accurately with apparatus constructed according to the present invention. It should be noted that throughout the description of the structure and operation of the preferred embodiment of this invention, the term "lateral" is intended to include any cut that extends from one side of the tape to the other regardless of the angle between the longitudinal axis of the tape and the cut.

The cutting apparatus 10 illustrated in the drawings utilizes a rotary cutter blade 12 for cutting the tape 100. It is of course to be understood that the method and apparatus of the present invention can be used to advantage with other known types of laterally-moving cutting blades in tape laying machines. However, a rotary cutting blade such as the blade 12 shown in the drawings is preferred because the overall efficiency of the machine and quality of the cut are greatest when a rotary cutter is used. A rotary blade is preferable over a non-rotating blade that is pulled across the tape because the latter has a tendency to pull the tape out of the tape guide and also a tendency to pull fibers of the tape loose from the backing paper. In addition, such blades, when made from presently known materials, become dull much faster then a rotary blade because they have a single cutting point as opposed to the full circumference of cutting points in a rotary blade. Therefore, the method and apparatus of the present invention can be used to best advantage in a tape laying machine that utilizes a rotary cutter blade.

The drawings show the preferred embodiment of the controlled depth cutting apparatus of the invention. The apparatus includes the rotary cutter blade 12 and a drive motor 14 for the blade 12. The cutter may be driven by an electric motor or an air powered motor. The electric motor is generally preferred since air powered motors have a tendency to contaminate the atmosphere with particles of oil. Such contamination of the atmosphere is highly undesirable in an environment in which composite structures are being manufactured. Referring to FIGS. 2–4, a solenoid 16 is provided for moving the cutter blade 12 toward the tape 100 and into its cutting position. A spring 18 moves the blade 12 back out of its cutting position when the solenoid 16 is not actuated.

An anvil 20 supports the tape 100 and backing paper 102 as the tape is being cut. In conventional tape laying machines, the anvil associated with the cutter is stationary. The anvil 20 shown in the drawings, in accordance with the present invention, moves laterally with respect to the tape as the cut is being made. As shown in FIGS. 2–4 both the cutter 12 and the anvil 20 are mounted on a C-shaped frame 34. This frame 34 moves laterally to laterally move the cutter 12 and anvil 20. The simultaneous movement of the cutter 12 and anvil 20 allows a single support point on the anvil 20 to remain beneath the cutting point of the blade 12 throughout the entire length of the lateral cut. Therefore, the distance between the blade 12 and anvil 20 remains constant and the depth of the cut is kept constant to a highly accurate degree.

The C-shaped frame 34 is a rigid structure that has an outer arm 36 and an inner arm 38. The rotary cutter 12 is mounted on the outer arm 36, and the anvil 20 is mounted on the inner arm 38. The rigidity of the C-shaped frame 34 insures that the movement of the cutter 12 and anvil 20 will be simultaneous and that the distance between the cutter 12 and anvil 20 will remain constant throughout the entire length of the lateral cut. Any variation in the motion of the C-shaped frame will equally affect the cutter 12 and the anvil 20. The lateral movement of the C-shaped frame 34 is provided by a screw drive 32, as shown in FIGS. 2–4. Of course various other types of drive means could be used to laterally move the C-shaped frame 34 without departing from the spirit and scope of the present invention. However, the screw drive 32 is preferred because of its strength, durability, and high degree of accuracy and adjustability. The screw drive 32 preferably is of the ball screw type to maximize the smoothness of the operation.

The size and shape of the anvil may be varied considerably without departing from the spirit and scope of the present invention. However, the drawings show the preferred embodiment of the anvil 20. The anvil 20 shown in the drawings is relatively small and the surface 21 that faces the cutter 12 is crowned or rounded. Only a very small area of contact between the anvil and the backing paper 102 is necessary to provide the required support for the tape 100 and paper 102 to carry out the cutting operation of the tape 100. The crowning of the anvil 20 allows the anvil 20 to slide easily under the paper 102. There is less drag than there would be if the area of contact were larger and the rounded surface 21 has no edges that are likely to catch on the paper 102. Another advantage of the crowned shape of the anvil 20 is that the highest point is in the center directly under the cutting point of the cutting blade 12. This insures that there are no points on the surface 21 of the anvil 20 that are higher than the contact point and that could therefore interfere with the supporting function of the anvil 20.

The cutting method and apparatus of the present invention are used to best advantage in tape laying machines that also incorporate a tape guide constructed in accordance with another invention by the applicant that is the subject of a copending application of the applicant entitled Cutting Method And Apparatus For Tape Laying Machines, which application was filed concurrently with the present application. The tape guide 22 shown in the drawings is constructed in accordance with the preferred embodiment of the invention disclosed in that copending application. The guide 22 has two longitudinal sections that are spaced apart longitudinally to define a gap 30 therebetween. This gap 30 provides an opening to accommodate the moving C-shaped frame 34 and anvil 20. The crowned surface 21 of the anvil 20 is positioned to extend a very small amount out of the gap 30 toward the cutter 12. This insures that the support point on crowned surface 21 is the highest point along the path of the tape 100 through the cutting apparatus 10 so that the tape 100 will progress smoothly and will be adequately supported by the anvil 20 for the cutting operation.

The tape 100 and backing paper 102 move along the tape guide 22 as they progress from the supply reel 4 to the tape laying head 8. The movement of the tape through the tape laying machine is indicated by the arrows in FIG. 1. The tape guide 22 guides the tape 100 and paper 102 into position for the tape 100 to be cut by the rotary cutter blade 12. Each of the two longitudinal sections of the tape guide 22 has an essentially flat center portion 24 extending along its length. Each longitudinal section also has two opposite sidewalls 26. Between each sidewall 26 and its associated flat center portion 24 is a side portion 28 that is inclined toward the cutting blade 12 relative to the flat center portion 24. These opposite side portions 28 of the tape guide 22 may be either angled or curved toward the cutting blade 12. However, in the preferred embodiment the side portions 28 are curved since it is easier to manufacture curved as opposed to angled side portions and since curved side portions result in smaller nicks in the lateral edges of the backing paper 102 produced during the cutting operation. The construction of the tape guide 22 is a part of the invention disclosed in the copending application discussed above and is in no way a part of the present invention. However, the two inventions are preferably used together in order to achieve maximum accuracy and completeness in the cutting operation.

During the operation of the tape laying machine 2, the tape 100 and backing paper 102 are moved along the tape guide 22 onto the anvil 20 and into position for the tape 100 to be cut by the blade 12. As the tape 100 and paper 102 are being moved, the tape guide 22 maintains the transverse center portions of the tape 100 and paper 102 in an essentially flat position. The side portions 28 of the tape guide 22 guide the lateral edge portions of the tape 100 and paper 102 to bend toward the cutting blade 12 and away from the anvil 20. This bending of the lateral edge portions is maintained along both longitudinal sections of the tape guide 22 and across the gap 30 in which the anvil 20 is positioned. The support and guiding of the lateral edge portions on either side of the gap 30 into the bent or bowed position maintains the bending of the lateral edge portions toward the cutter blade 12 across the gap 30 when a lateral cut is being made. This allows a lateral cut of essentially constant depth to completely sever the tape 100, including any fibers that may have become loose from the edges of the backing paper 102, without severing the backing paper 102. The tape guide 22 is dimensioned so that the flat center portions 24 are sufficiently wide to provide an uncut center portion of the backing paper 102 that is sufficiently wide to prevent any nicks in the lateral edge portions of the backing paper 102 from impairing the transport of the tape 100 by the backing paper 102.

The extremely accurate depth control of the present invention provides a lateral cut of essentially constant depth. This insures that the tape 100 is completely severed down to the last fiber. Before beginning the cutting operation, the depth of the cut is set by setting the distance between the cutter 12 and the anvil 20. As shown in the drawings, this is accomplished by rotating adjustable stop 40 which is threaded onto the top of shaft 42 which is in turn connected to cutter 12. Rotating stop 40 moves cutter 12 toward or away from anvil 20. Of course, the distance between cutter 12 and anvil 20 could be set by any of a variety of other means without departing from the spirit and scope of the invention. Such other means would include means for moving anvil 20 rather than cutter 12.

Once the distance between the support point on the anvil 20 and the cutting point of the cutter 12 is set, it remains constant throughout the cutting operation. The distance is set to be slightly less than the thickness of the backing paper 102. This insures that all of the fibers of the tape 100 will be severed without severing the paper 102. The details of the cutting operation of the flat center portion of the tape 100 are perhaps best shown in FIGS. 5 and 6. In these figures it can be clearly seen that the tape 100 is being completely severed and that the paper 102 is merely being grazed by the laterally-moving rotary cutter blade 12. The grazing of the cutting paper 102 is minor and does not interfere with its tape transport function. In FIG. 5, the approximate magnitudes of the thicknesses of the tape 100, the paper 102, and the cut are indicated in thousandths of an inch. In order to prevent any variations in the radius of the cutter 12 from creating variations in the depth of the cut, the cutter 12 is precisely machined and is driven to rotate at a very fast rate to maximize the circumferential extent of the contact between the cutter 12 and each portion of the tape 100.

In this description of the preferred embodiment of the invention, the phrase "cut of essentially constant depth" and the like are intended to mean a cut that leaves an uncut layer of material (backing paper) of essentially constant thickness. To leave such a layer, the cut would generally be of essentially constant depth, but of course variations in paper thickness and/or thickness of the tape layer would cause corresponding variations in the actual depth of the cut. The distance between the cutter 12 and anvil 20 is set to be very slightly less than the thickness of the paper 102 at its thinnest point.

Throughout the description of the preferred embodiment of the method and apparatus of the present invention, the invention has been described in the context of a tape laying machine. It is anticipated that this environment will be the primary use for the method and apparatus of the invention. However, it is to be understood that the method and apparatus of the invention may also be used to advantage in other environments in which it is necessary to attain a high degree of accuracy of depth control in a cutting operation.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined by the following claims.

What is claimed is:

1. Apparatus for making a cut in sheet material along a cutting path while maintaining along said path an uncut layer of said material of essentially constant thickness, comprising:

frame means having opposed first and second portions positioned to move along said path;

cutting means mounted on said first portion to move with said first portion along said path; and an anvil fixedly mounted on said second portion facing the cutting means to move simultaneously with said first and second portions and the cutting means along said path, said anvil having a single constant support point positioned to contact and support the portion of the material being cut;

said cutting means being positioned to maintain an essentially constant distance between itself and said support point on the anvil;

wherein when a cut is being made, said first and second portions move along said path with said material therebetween; and wherein the simultaneous movement of the cutting means and the anvil and the maintenance of said essentially constant distance maintain along the cutting path an uncut layer of said material of essentially constant thickness.

2. Apparatus as described in claim 1, in which the frame means comprises a rigid generally C-shaped frame having a center portion and two opposed spaced-apart arms projecting generally perpendicularly outwardly from said center portion, and in which said arms include said first and second portions.

3. Apparatus as described in claim 2, further comprising drive means for moving said frame to move said first and second portions along said path.

4. Apparatus as described in claim 1, in which the cutting means comprises a rotary cutting blade.

5. Apparatus as described in claim 4, further comprising cutter drive means for rotating said cutting blade at a sufficiently high rate to ensure that a maximum radius portion of the blade comes into cutting contact with each portion of the material being cut.

6. Apparatus as described in claim 1, in which the anvil includes a rounded support surface facing the cutting means, said surface having an apex forming said support point for the portion of the sheet material being cut by the cutting means.

7. In a tape laying machine of the type in which a tape to be laid is transported by a continuous strip of backing material, improved cutting apparatus for making lateral cuts through the tape, comprising:

frame means having opposed first and second portions positioned to move laterally across the tape;

cutting means mounted on said first portion to move with said first portion laterally across the tape; and an anvil fixedly mounted on said second portion facing the cutting means to move simultaneously with the cutting means and said first and second portions of the frame means laterally across the tape, said anvil having a single constant support point positioned to contact and support the backing material on the portion of the tape being cut and to support the tape being cut;

said cutting means being positioned to maintain an essentially constant distance between itself and said support point on the anvil, said distance being slightly less than the thickess of the backing material;

wherein when a lateral cut through the tape is being made, said first and second portions move laterally across the tape with the tape and the backing material therebetween; and wherein the simultaneous movement of the cutting means and the anvil and the maintenance of said essentially constant distance maintain an essentially constant depth of the cut and completely sever the tape without severing the backing material.

8. Apparatus as described in claim 7, in which the frame means comprises a rigid generally C-shaped frame having a center portion and two opposed spaced-apart arms projecting generally perpendicularly outwardly from said center portion, and in which said arms include said first and second portions.

9. Apparatus as described in claim 8, further comprising drive means for moving said frame to move said first and second portions laterally across the tape, said drive means comprising ball screw drive means.

10. Apparatus as described in claim 7, in which the cutting means comprises a rotary cutting blade.

11. Apparatus as described in claim 10, further comprising cutter drive means for rotating said cutting blade at a sufficiently high rate to ensure that a maximum radius portion of the blade comes into cutting contact with each portion of the tape being cut.

12. Apparatus as described in claim 7, further comprising a guide surface along which the tape and backing material move into position for the tape to be cut by the cutting means, said guide surface including two longitudinally spaced longitudinal sections defining a gap therebetween in which the anvil moves, said anvil being positioned to extend slightly out of said gap toward the cutting means.

13. Apparatus as described in claim 7, in which the anvil includes a rounded support surface facing the cutting means, said surface having an apex forming said support point for the portion of the tape being cut by the cutting means.

14. Apparatus as described in claim 12, in which the anvil includes a rounded support surface facing the cutting means, said surface having an apex forming said support point for the portion of the tape being cut by the cutting means; and in which said apex extends slightly out of said gap toward the cutting means.

15. In a system in which tape in a tape laying machine is transported by a continuous strip of backing material and in which said machine has cutting means for making lateral cuts through the tape and support means for the tape and backing material, a method of controlling the depth of said cuts to completely sever the tape without impairing the transport of the tape, said method comprising:

fixedly mounting the support means with respect to the cutting means;

positioning the cutting means to maintain an essentially constant distance between the cutting means and a single constant support point on the support means;

moving the tape and the backing material between the cutting means and the support means into position for the tape to be cut by the cutting means;

cutting the tape with the cutting means, and supporting the portion of the tape being cut and the backing material with said support point of the support means;

while cutting the tape and supporting said portion of the tape and the backing material, moving the cutting means and the support means simultaneously laterally across the tape and the backing material and maintaining said essentially constant distance between the cutting means and said support point, to thereby maintain an essentially constant depth of the cut and completely sever the tape without severing the backing material.

16. A method as described in claim 15, in which the step of cutting the tape with the cutting means comprises rotating a circular blade portion of the cutting means at a sufficiently high rate to ensure that a maximum radius portion of said circular blade portion comes into cutting contact with each portion of the tape being cut.

* * * * *

UNITED STATES PATENT AND TRADEMARK OFFICE

CERTIFICATE OF CORRECTION

PATENT NO. : 4,517,872

DATED : May 21, 1985

INVENTOR(S) : Helmut Dontscheff

It is certified that error appears in the above-identified patent and that said Letters Patent are hereby corrected as shown below:

Column 6, line 32, "1" should be -- 2 --.

Column 6, line 37, "1" should be -- 2 --.

Signed and Sealed this

*Eighth* Day of *July 1986*

[SEAL]

*Attest:*

DONALD J. QUIGG

*Attesting Officer*

*Commissioner of Patents and Trademarks*